United States Patent [19]

Hurley

[11] 4,138,988

[45] Feb. 13, 1979

[54] OVEN DOOR HINGE

[75] Inventor: James E. Hurley, Chattanooga, Tenn.

[73] Assignee: McGraw-Edison Company, Elgin, Ill.

[21] Appl. No.: 853,034

[22] Filed: Nov. 21, 1977

[51] Int. Cl.[2] ..... F23M 7/00

[52] U.S. Cl. ..... 126/194; 49/386

[58] Field of Search ..... 49/386; 126/194

[56] References Cited

U.S. PATENT DOCUMENTS

| | | | |
|---|---|---|---|
| 2,721,547 | 10/1955 | Pollock | 126/191 |
| 2,842,117 | 7/1958 | Berge et al. | 126/194 |
| 3,398,735 | 8/1968 | Barber | 126/191 |

*Primary Examiner*—John J. Camby
*Assistant Examiner*—Larry I. Schwartz
*Attorney, Agent, or Firm*—Ronald J. LaPorte; Jon C. Gealow

[57] ABSTRACT

A hinge assembly for removably mounting an oven door on the front wall of the cabinet of a food processing oven for movement between open and closed positions with respect to the oven cavity includes a hinge plate mounted in overlying relation with respect to the front wall at one side of the oven cavity, a hinge arm on which the oven door is removably mounted pivotally attached to the hinge plate, a support arm joined pivotally at one end to the hinge arm and extending into the oven cabinet alongside the oven cavity through an aperture in the hinge plate and an aligned aperture in the front wall of the oven cabinet and a spring attached at the opposite end of the support arm and cabinet frame, to bias the oven door to a "closed door" position. The hinge assembly includes the improvement of a permanently affixed stop to prevent damage to the front wall of the oven cabinet after the door is removed from the hinge arm, because of engagement by the hinge arm if the latter is pulled forcibly by the biasing spring toward the front wall. The stop includes a pin mounted on and extending transverse the support arm for engagement with the hinge plate prior to the hinge arm engaging the front wall of the cabinet. The stop pin is ineffective to engage the hinge plate when the oven door is mounted on the hinge arm.

8 Claims, 4 Drawing Figures

OVEN DOOR HINGE

BACKGROUND OF THE INVENTION

This invention relates generally to food processing oven door structures and more particularly to hinge assemblies for use with such oven door structures.

Oven doors which can be removed from the hinge assemblies upon which they are mounted for opening and closing the doors are well known in the art, see for example U.S. Pat. Nos. 3,304,932; 3,398,735; 3,155,088; 3,842,542; and U.S. Pat. No. Re. 25,236. In the case of these arrangements, two hinge assemblies are conventionally employed, one at each side of the oven cavity. Each hinge assembly comprises a hinge plate attached to the front wall of the oven cabinet, a hinge arm on which the door is mounted, coupled to the hinge plate for pivotal movement with respect thereto and a roller or support arm pivotally attached to the hinge arm and passing through the hinge plate into the cabinet, alongside the oven cavity. A spring is coupled to the roller arm to bias the hinge arm toward a vertically oriented, "closed door" position.

The roller arm is normally shaped to include notches or recesses along an edge thereof in which a roller mounted at the rear of the hinge plate is received. The recesses are provided to maintain the oven door in positions of varying degrees of closure.

When the oven door is removed from the hinge arms, normally by sliding the door therefrom, the hinge arms are typically placed to a partially opened condition. Subsequent to the removal of the oven door, one or both of the hinge arms often is pulled toward the "closed door" position by a respective biasing spring because of a reduction in mass due to the removal of the door. In the last-mentioned situation, the hinge arm can engage the oven front wall which is normally coated with porcelain or a similar material, with such force that the porcelain will be chipped therefrom.

In the case of some removable oven door arrangements, pins are required to be inserted into the support arms of the hinge assemblies prior to removal to serve as a stop, whereby the oven door is held open at a predetermined position so that the door may be removed from the hinge arms. See U.S. Pat. Nos. 2,721,547 and 2,842,117 for examples of such arrangements. In the last-mentioned cases, the pins are required to hold the hinge arms at a predetermined angle with respect to the front wall of the oven cabinet as the door is removable only at that angle. While the insertion of the stop pins also indirectly alleviates the problem of the hinge arms forcibly engaging the porcelain coated front wall of the oven cabinet after the door is removed, the disadvantage in such arrangements is that the pins are inserted only when removing the oven door and thus must be removed and stored when not in use. Furthermore, so long as the pins are in place, the hinge arms extend at the prescribed angle from the front wall of the oven cabinet and could cause injury if engaged inadvertently by someone passing too near the oven.

SUMMARY OF THE INVENTION

Accordingly, it is a primary object of the present invention to provide a new and improved oven door hinge assembly upon which an oven door may be removably mounted, which hinge assembly includes means for preventing the engagement of the front wall by the hinge arm being pulled theretoward, subsequent to removal of the oven door, thereby to prevent damage to the front wall, while avoiding the disadvantages of prior art arrangements described heretofore.

It is another object of the present invention to provide a new and improved hinge assembly of the above-described type which is relatively simple in construction yet effective to prevent damage to the front wall of the oven cabinet as was described hereinabove.

Briefly, a preferred embodiment of the oven door hinge assembly according to the invention includes a hinge bracket or plate mounted on the front wall of an oven cabinet over a suitable aperture therethrough on one side of the oven cavity. An oven door hinge arm is joined to the hinge plate at the lower end thereof for pivotal movement with respect thereto. A support arm having predeterminedly positioned notches therealong is attached pivotally at one end to the hinge arm and a spring is coupled to the opposite end of the support arm and to the oven cabinet. The support arm passes through the hinge plate and front wall of the oven cabinet alongside the oven cavity. The spring pulls the support arm normally into the oven cabinet and thereby biases the hinge arm toward a vertically oriented, "closed door" position. The support arm cooperates with a roller mounted on the inside surface of the hinge plate to permit the positioning of the oven door to various, partially opened positions. Two such hinge assemblies are provided in a typical oven, one on each side of the oven cavity. When the oven door is "closed" so that the inner surface thereof engages the front wall of the oven cabinet, the hinge arms are substantially vertically oriented.

A stop pin permanently affixed in the support arm of each hinge assembly, extending transverse thereto and predeterminedly spaced from the hinge arm, is provided for engagement of the hinge plate when the oven door is removed to prevent a corresponding hinge arm from engaging and damaging the front wall of the oven cabinet. In normal use, when the oven door is in place on the hinge arms and is moved to a closed position with respect to the oven cavity, the respective stop pins are spaced from the hinge plate.

DETAILED DESCRIPTION OF THE DRAWINGS

Figure 1:
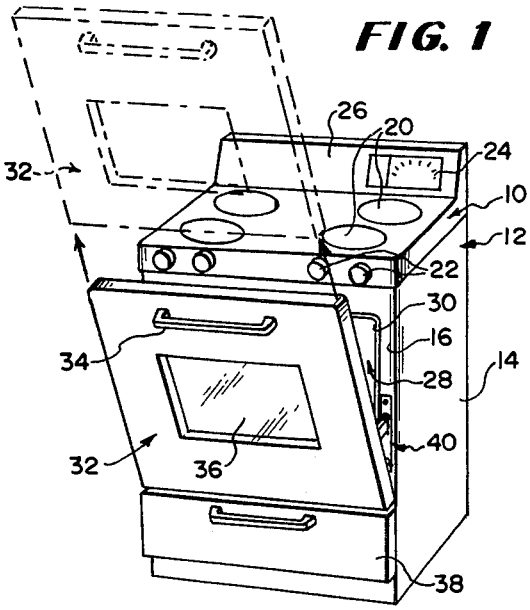
FIG. 1 is a perspective view of a typical range having an oven and a removable oven door mounted on hinge assemblies according to the invention.

Referring now to the drawings in greater detail wherein like numerals have been employed throughout the various views to designate similar components, there is shown in FIG. 1 a typical range designated by the numeral 10, including an outer cabinet 12 having adjoining upper, lower, front, rear and side walls. In FIG. 1 only side wall 14 and front wall 16 are shown. The cabinet including front wall 16 thereof is constructed of sheet metal onto which is coated a layer or layers of porcelain or the like material, the last-mentioned material being subject to chipping, scratching, etc. if forcibly engaged by an object.

A cooking range top 18 of a conventional type is mounted on the top wall of the cabinet 12. The cooking range top 18 includes the usual burners such as 20, controls 22 and a timer or clock 24 mounted on a back panel 26 of the range top.

The cabinet 12 defines an oven cavity 28 having a front opening 30 covered by an insulated oven door 32. The oven door 32 is of a conventional design having a handle 34 for opening and closing the door with respect to the oven cavity and a centrally located glass window 36 through which one can observe the condition of the food being cooked therein. A lower utility drawer 38 is provided in the cabinet 12 for storing pots, pans, etc.

The oven door 32 is mounted on the cabinet 12 for pivotal movement between open and closed positions with respect to the oven cavity, by means of a pair of hinge assemblies, such as, for example, 40 according to the invention.

Figure 2:
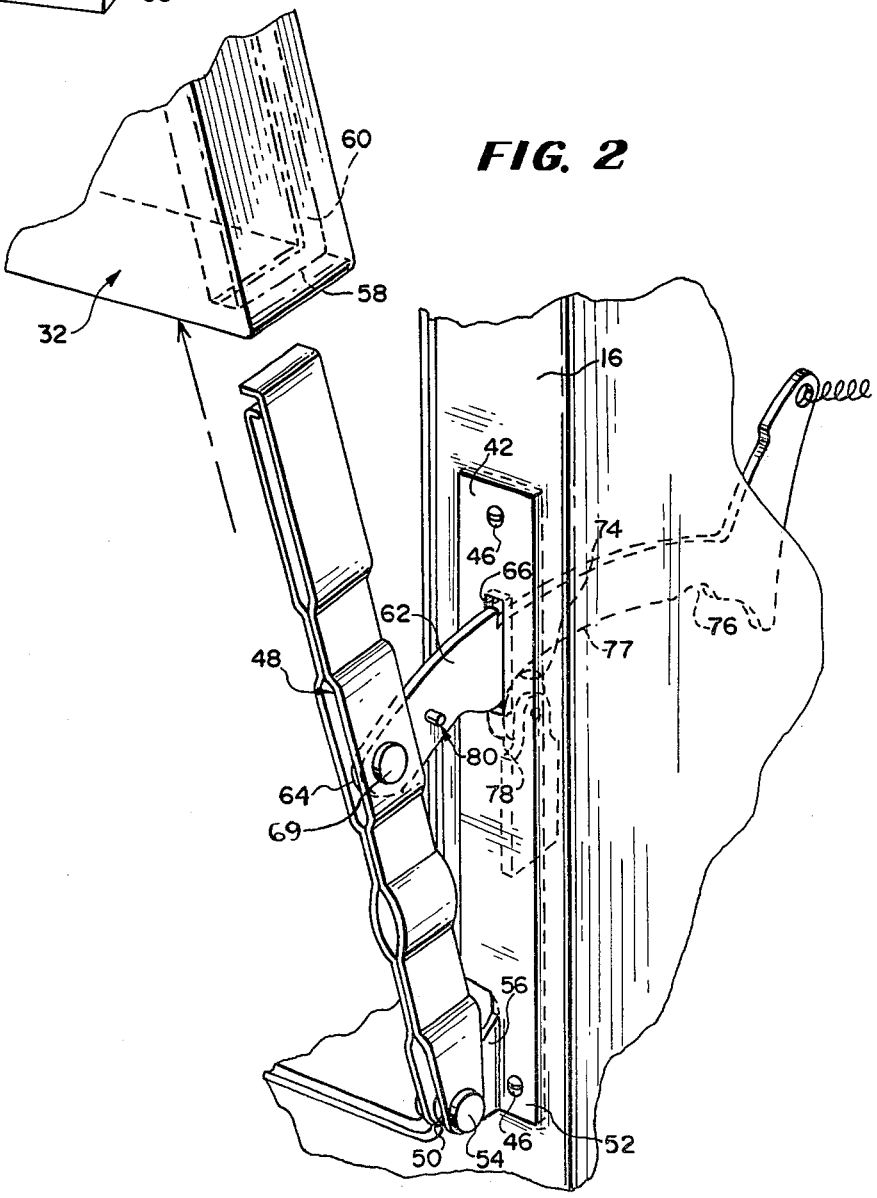
FIG. 2 is an enlarged perspective view of an oven door hinge assembly according to the invention.
Figure 3:
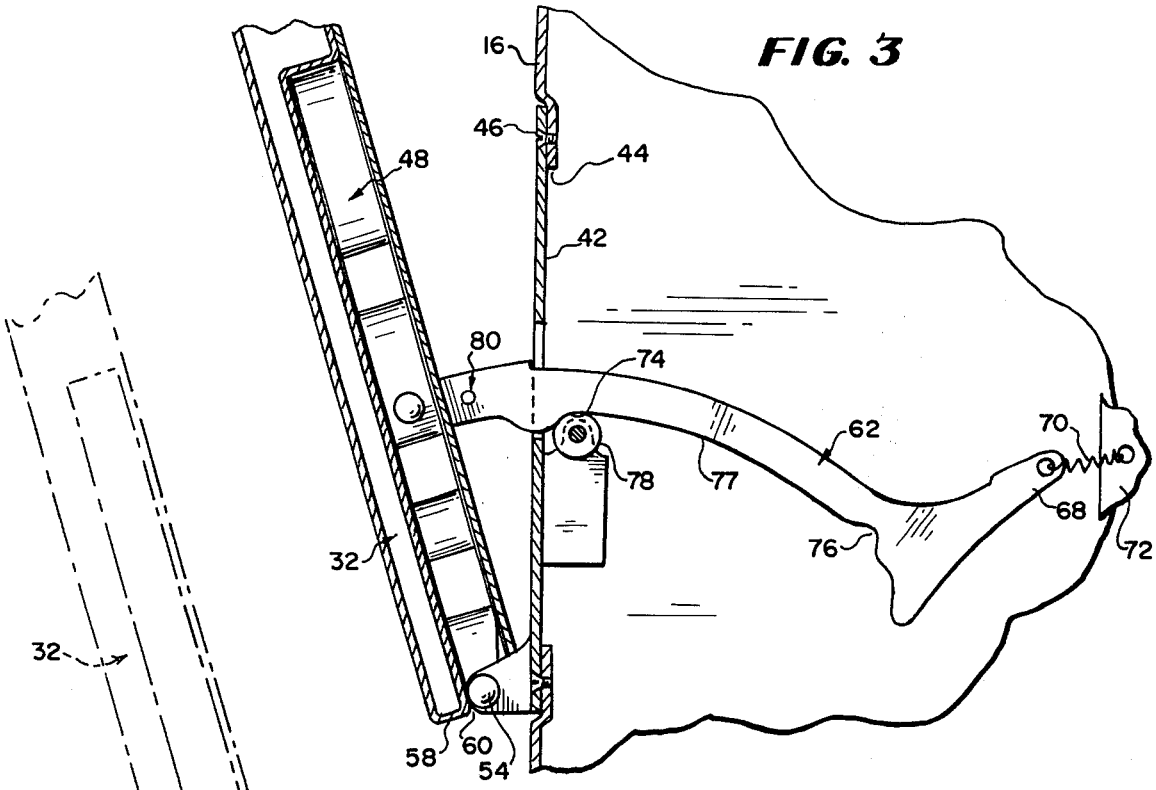
FIGS. 3 and 4 are side fragmentary views of the removable oven door and oven door hinge assembly according to the invention illustrating the improvement thereof provided to prevent damage to the front wall of the oven when the oven door is removed.
Figure 4:
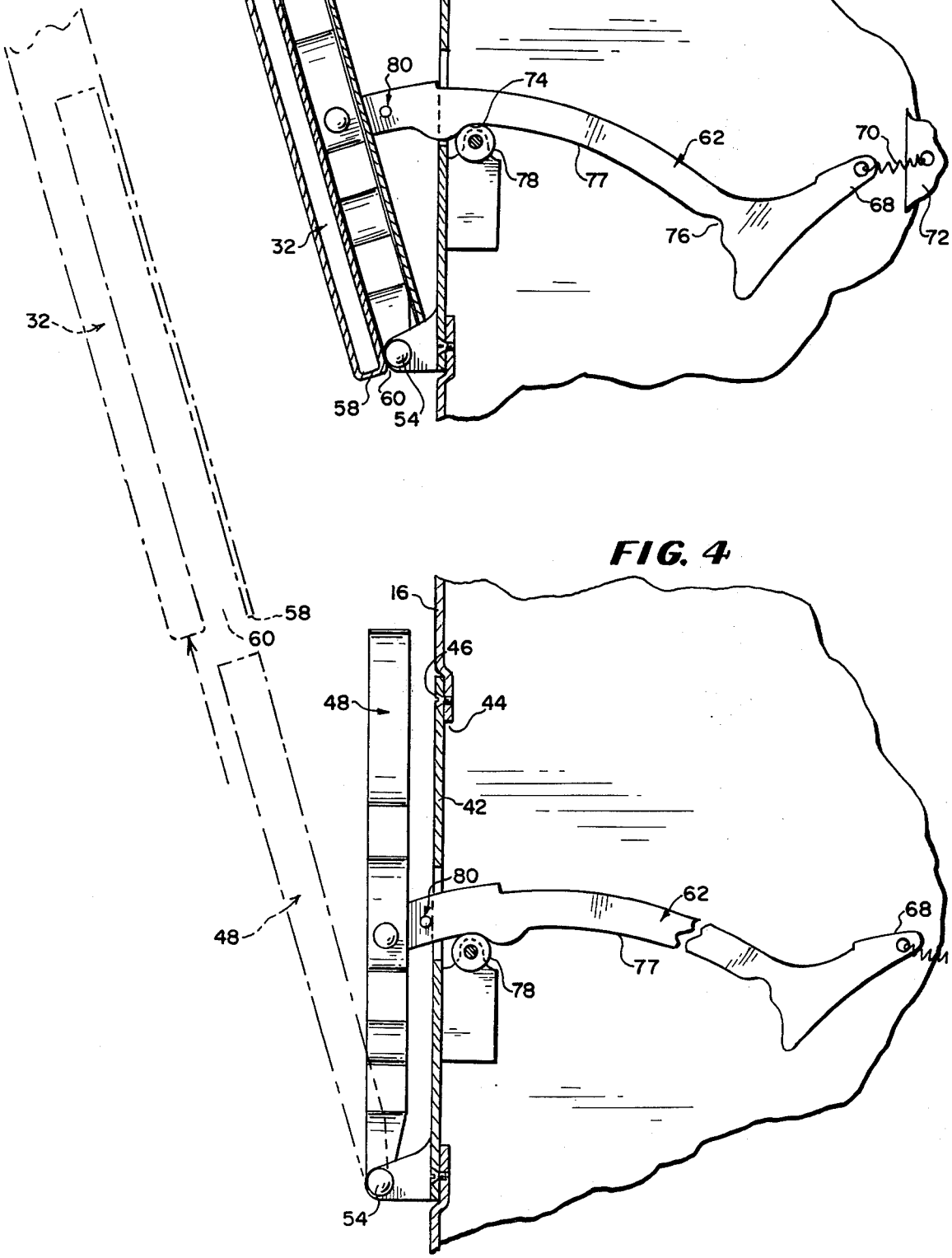

A preferred embodiment of an oven door hinge assembly 40 of FIG. 1 is illustrated in FIGS. 2–4 of the drawings. The assembly 40 includes a hinge plate or bracket 42 which is mounted in overlying relation on the front wall 16 of the oven cabinet at the side of the oven cavity, in alignment with an aperture 44 provided in the front wall 16. Suitable fasteners, such as screws 46, are employed for this purpose. A hinge arm 48 is attached at its lower end 50 to the lower end 52 of the hinge plate for pivotal movement with respect thereto. As seen in FIGS. 2–4, a rivet or the like fastener 54 passes through an ear 56 extending from hinge plate 42 and lower end 50 of the hinge arm to secure the latter to the former. As shown in the drawings, oven door 32 includes openings such as 60 extending thereinto from the lower edge 58 thereof for receiving hinge arms such as 48 thereby to mount the door on the hinge arms.

A support or roller arm 62 is pivotally attached at a first end 64 thereof by means of a rivet 69 or the like fastener to the hinge arm 48. The support arms extends transverse the hinge arm, through a slotted aperture 66 in the hinge plate 42 and aperture 44 in the front wall of cabinet 12, into the cabinet alongside the oven cavity. The opposite end 68 of the support arm is coupled via spring 70 to the cabinet frame 72 as shown in FIGS. 3 and 4. The spring 70 biases the hinge arm 48 toward the front wall of the cabinet to a "closed door" position.

Support arm 62 is shaped to include a plurality of notches or recesses such as 74, 76, along one edge 77 thereof. A roller 78 mounted on a suitable bracket extension attached to plate 42 within the cabinet 12, cooperates with the recesses to hold the oven door in various positions with respect to the front opening 30 of the oven cavity. The last-described support arm-roller type arrangement is well known in the art.

When it is desired to remove the oven door 32 from the hinge arms 48 of the hinge assembly, the door is opened partially. This can be accomplished by pivoting the door so that roller 78 falls into and is held in recess 74 on the support arm. Thereafter, oven door 32 is removed by the lifting thereof from the hinge arms, as illustrated in FIGS. 1, 2 and 4 of the drawings.

To prevent hinge arm 48 from being pulled forcibly into engagement with the front wall 16 of the cabinet by spring 70, once the door is removed, a stop pin 80 has been provided for engagement with hinge plate 42 prior to the hinge arm engaging front wall 16. The stop pin 80 is permanently affixed to support arm 62 and is predeterminedly spaced from the hinge arm to insure that no engagement of the latter with the cabinet front wall 16 will take place if the spring 70 should forcibly urge the hinge arm toward the wall 16 after removal of the oven door. The stop pin 80 extends through the support arm transverse thereto and outwardly therefrom sufficiently so that it will not pass through slotted aperture 66 in the hinge plate.

When the oven door is placed on hinge arms 48, respective stop pins 80 will not engage the corresponding hinge plates upon closing the door fully against the front wall 16 of the cabinet 12. As such, pins 80 are not effective when oven door 32 is in place on the hinge arms.

The stop pin 80 included in the hinge assembly according to the invention insures that the relatively fragile front wall 16 of the oven cabinet will not be chipped, scratched, dented, etc. due to engagement thereof by the hinge arm 48 after the removal of the oven door 32 therefrom. The stop pin 80 is simple, yet highly effective to perform the function for which it is provided. The stop pin 80 is also very low in cost.

While a particular embodiment of the invention has been shown and described, it should be understood that the invention is not limited thereto since modifications thereof may be made. It is therefore contemplated to cover by the present application any and all such modifications as fall within the true spirit and scope of the appended claims.

What is claimed is:

1. A hinge assembly for removably mounting an oven door to the front wall of an oven cabinet for movement between open and closed positions with respect to an oven cavity defined therein, the front wall having an aperture defined therein adjacent said oven cavity, said hinge assembly including in combination:

a hinge plate having an aperture therethrough, attached to said front wall in overlying relation with respect to said aperture in said front wall, a hinge arm for removably receiving said oven door, said hinge arm being coupled to said plate for pivotal movement with respect thereto, a support arm joined to said hinge arm and passing through said hinge plate and said aperture in said front wall into said oven cabinet alongside said oven cavity, said support arm being movable to position said hinge arm and oven door to various positions with respect to said front wall of said oven, and biasing means coupled to said support arm urging the latter into said oven cabinet and said hinge arm toward said front wall, and permanently affixed stop means on said support arm for engagement with said hinge plate upon removal of said oven door from said hinge arm and movement of the latter toward said front wall for preventing forcible engagement of said hinge arm with said front wall, said stop means being spaced from said hinge plate when said oven door is received on said hinge arm and the door is moved from a fully open to a closed position with respect to said oven cavity.

2. A hinge assembly as claimed in claim 1 wherein said stop means includes a pin member extending transversely into said support arm and being spaced predeterminedly from said hinge arm.

3. A hinge assembly for removably mounting an oven door on the front wall of an oven cabinet for movement between open and closed positions with respect to an oven cavity defined therein, said hinge assembly including in combination:

a hinge plate attached to said front wall in close proximity to said aperture, a hinge arm for removably receiving said oven door, said hinge arm being coupled to said plate for pivotal movement with respect thereto, means joined to said hinge arm biasing the latter toward said hinge plate for moving said oven door to a closed position with respect to said oven cavity, and permanently affixed stop means provided on said hinge assembly for engagement with said hinge plate upon removal of said oven door from said hinge arm and movement of the latter toward said front wall for preventing forcible engagement of said hinge arm with said front wall, said stop means being ineffective to engage said hinge plate when said oven door is received on said hinge arm and the door is moved from a fully open to a closed position with respect to said oven cavity.

4. A hinge assembly as claimed in claim 3 wherein said hinge arm biasing means includes a support arm pivotally attached at the first end to said hinge arm and a biasing spring attached to the opposite end of said support arm for urging said hinge arm toward said hinge plate and wherein said stop means is mounted on said support arm at a predetermined location, spaced predeterminedly from said hinge arm.

5. A hinge assembly as claimed in claim 4 wherein said front wall defines an aperture adjacent said oven cavity, wherein said hinge plate defines an aperture therethrough, wherein said hinge plate is mounted on said front wall in overlying relation with said aperture in said front wall, wherein said support arm passes through said apertures in said hinge plate and front wall, respectively, alongside said oven cavity and wherein said stop means includes a member extending from said support arm and positioned for engagement with said hinge plate as said support arm passes therethrough.

6. A hinge assembly as claimed in claim 5 wherein said stop means includes a pin member affixed to said support arm and extends outwardly therefrom.

7. A food processing oven comprising a cabinet having a porcelain or the like coated front wall defining an opening into an oven cavity, said front wall also defining smaller apertures on opposite sides of said oven cavity opening, an oven door and hinge means mounted on said front wall for removably mounting said oven door over said opening for movement between open and closed positions with respect thereto, said hinge means comprising a pair of hinge assemblies mounted on opposite sides respectively of said opening on said front wall, each said hinge assembly including hinge plate means mounted on said front wall in an overlying relation with respect to a corresponding one of said apertures, a hinge arm coupled for pivotal movement to said hinge plate means and support arm means joined pivotally to said hinge arm for moving said hinge arm between selected positions with respect to said front wall, said support arm means extending through said hinge plate means and a respective front wall aperture into said oven cabinet alongside said oven cavity, and biasing means coupled to said support arm means urging said hinge arm toward a position substantially parallel to said front wall, said oven door being removably received on said hinge arms, and permanently installed stop means on each said support arm provided for engagement of a respective hinge plate upon removal of said oven door and movement of said hinge arm toward said front wall, for preventing engagement of said hinge arm with said front wall and damage to the coating thereon, each said stop means being spaced from a respective hinge plate when said oven door is in place on said hinge arms and the oven door is moved from a fully open to a closed position with respect to said oven cavity opening.

8. A food processing oven as claimed in claim 7 wherein the stop means of each said hinge assembly includes a pin member permanently affixed to a corresponding support arm and extending transverse thereto, said stop means being spaced predeterminedly from said hinge arm to prevent engagement of the latter with said front wall of said oven cabinet when said stop means engages a respective hinge plate.

* * * * *